US006029556A

United States Patent [19]

Rexroad

[11] Patent Number: 6,029,556

[45] Date of Patent: Feb. 29, 2000

[54] AESTHETIC BARRIER/DEBRIS SYSTEM AND MATERIAL

[75] Inventor: John Rexroad, Killingworth, Conn.

[73] Assignee: Pacuda Inc. /Leading Edge Safety Systems, Deep River, Conn.

[21] Appl. No.: 09/245,258

[22] Filed: Feb. 5, 1999

Related U.S. Application Data

[63] Continuation-in-part of application No. 09/020,830, Feb. 9, 1998.

[51] Int. Cl.[7] ..... E04G 1/00

[52] U.S. Cl. ..... 87/22; 182/129; 256/37

[58] Field of Search ..... 87/13, 22; 473/493, 473/491, 494, 390; 52/660, 664; 256/37, 40, 44, 45, 32; 182/129; 273/400, 407

[56] References Cited

U.S. PATENT DOCUMENTS

| | | | |
|---|---|---|---|
| 3,717,327 | 2/1973 | Schmidth et al. | 256/40 |
| 4,805,735 | 2/1989 | Anderson | 182/138 |
| 5,299,655 | 4/1994 | Margaritis | 182/138 |
| 5,402,999 | 4/1995 | Keekn | 273/1.5 R |
| 5,564,711 | 10/1996 | Scheie | 273/400 |
| 5,582,266 | 12/1996 | Rexroad et al. | 182/138 |
| 5,730,442 | 3/1998 | Anderson | 273/400 |

FOREIGN PATENT DOCUMENTS

| | | |
|---|---|---|
| 7-18876 | 7/1995 | Japan . |

*Primary Examiner*—John J. Calvert
*Assistant Examiner*—Tejash Patel
*Attorney, Agent, or Firm*—Perman & Green, LLP

[57] ABSTRACT

A system for connecting a panel to a support comprises a mesh panel defined by at least one length portion and has a border connected to the length portion of the mesh panel. The border has a first end capable of being connected to a support and a second end adjustably connectable to an opposite support. A tensioning means is associated with the border second end for pulling the border in tension between the supports. The second end of the web is connectable to the tensioning means for tensioning the mesh panel material.

1 Claim, 21 Drawing Sheets

52

52

AESTHETIC BARRIER/DEBRIS SYSTEM AND MATERIAL

CROSS REFERENCE TO RELATED APPLICATIONS

This application is a continuation-in-part of Ser. No. 09/020,830 filed Feb. 9, 1998.

The present invention relates to copending U.S. patent application Ser. No. 08/789,416 filed Jan. 29, 1997 and entitled, Flat Braid With Web Core, and also relates to copending U.S. application Ser. No.: 08/414,185 entitled Hollow Braid Net and Method of Making, filed Mar. 31, 1995 and further relates to copending U.S. application Ser. No. 08/557,851, entitled Net With Flattened Surface Members Connected At Sewn Intersections, and to copending U.S. application Ser. No. 09/012,472, entitled Method of Using Barrier Material and System, filed Jan. 22, 1998 under EXPRESS MAIL No. EM174706093US, which applications being commonly owned and being hereby incorporated by reference herein.

BACKGROUND OF THE INVENTION

The present invention relates to a barrier which is usable as a decorative finish in a construction project, such as will be conducted on the Washington Monument in Washington D.C., wherein mesh panels are connected to scaffolding or other structure in a manner which presents the mesh outwardly to a viewer in a flat sheet form.

When a scaffolding is erected around a structure, such as around the Washington Monument, and work operations conducted on it, it is often necessary to enshroud the work environment so as to make the exterior appearance of the structure aesthetically pleasing to the viewers, especially in a landscape where an object stands out relative to the remainder of the environment. Prior art systems all include a secondary member, such as a cable, which needed to be used suspended between two vertical members so that tarpons could hang from the cable. Such a system does not provide a mesh which can be made taut and given a flat face appearance, which is part of a desired architectural effect.

Accordingly, it is an object of the invention to provide a decorative and/or debris inhibiting mesh panel which can be readily fastened to existing scaffolding erected around a structure so as to provide a more aesthetically pleasing view of the structure during construction and renovation, and provide ease of installation, maintenance and removal.

It is yet a further object of the invention to provide a mesh panel system whereby each panel is capable of being separately adjusted relative to the support to which it is attached such that a self-supporting system can be effected.

Still a further object of the invention is to provide a system of the aforementioned type which uses a hollow border member in which a slidable web or support member is housed in order to reduce secondary support systems which otherwise would be necessary in the installation of a mesh panel system.

Still a further object of the invention is to provide a system of the aforementioned type which uses a border member on which a plurality of loops are sewn in order to secure discrete sections of the mesh to vertically extending members.

Yet a further object of the invention is to provide a material of the aforementioned type which is capable of having a given color which is coordinated with the color scheme of a given environment.

Further objects and advantages of the present invention will become apparent from the following disclosure and appended claims.

BRIEF DESCRIPTION OF THE DRAWINGS

The file of this patent contains at least one drawing executed in color.

SUMMARY OF THE INVENTION

The invention resides in a system for connecting a panel to a support and comprises a mesh panel defined by at least one length portion and has a border connected to the length portion of the mesh panel. The border and has a first end capable of being connected to a support and a second end adjustably connectable to an opposite support. A tensioning means is associated with the border second end for pulling the border in tension between the supports. The second end of the web is connectable to the tensioning means for tensioning the mesh panel material.

DETAILED DESCRIPTION OF THE PREFERRED EMBODIMENTS

Figure 1:
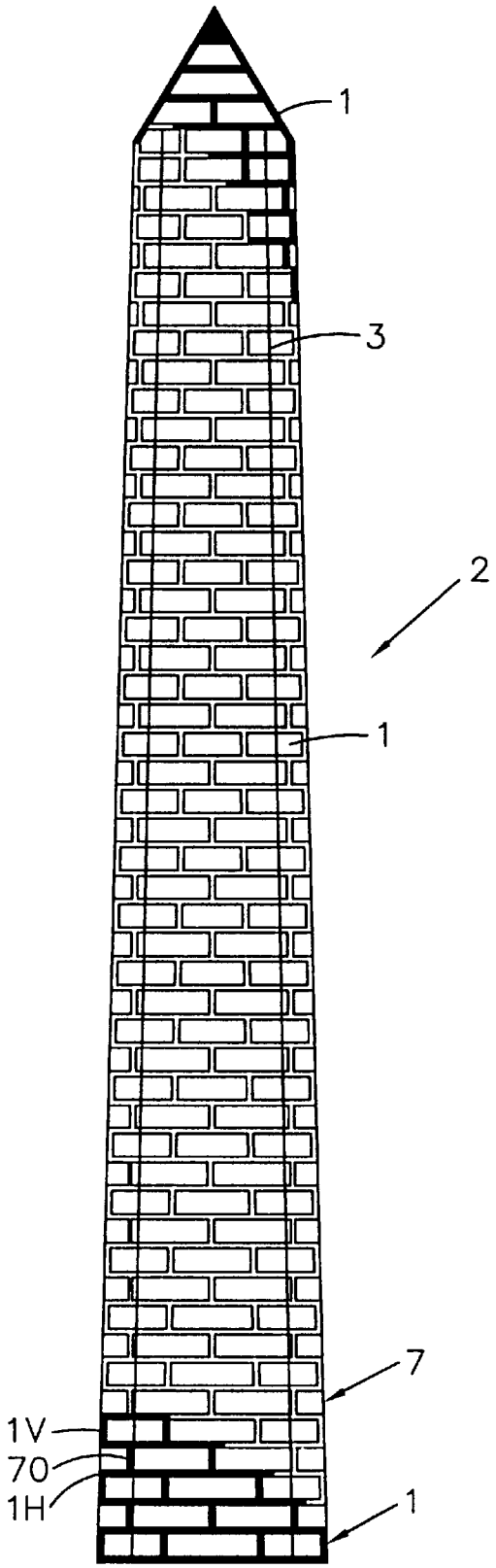
FIG. 1 is an elevation view of a structure which is enshrouded by scaffolding and covered by the panels of the present invention to create a desired appearance, and debris protection.

Referring now to FIG. 1 therein shown is a system 2 for mounting a mesh 1 onto a scaffolding system 7 which is erected around a structure 3, or to other structures, such as concrete columns in a construction project.

Figure 2:
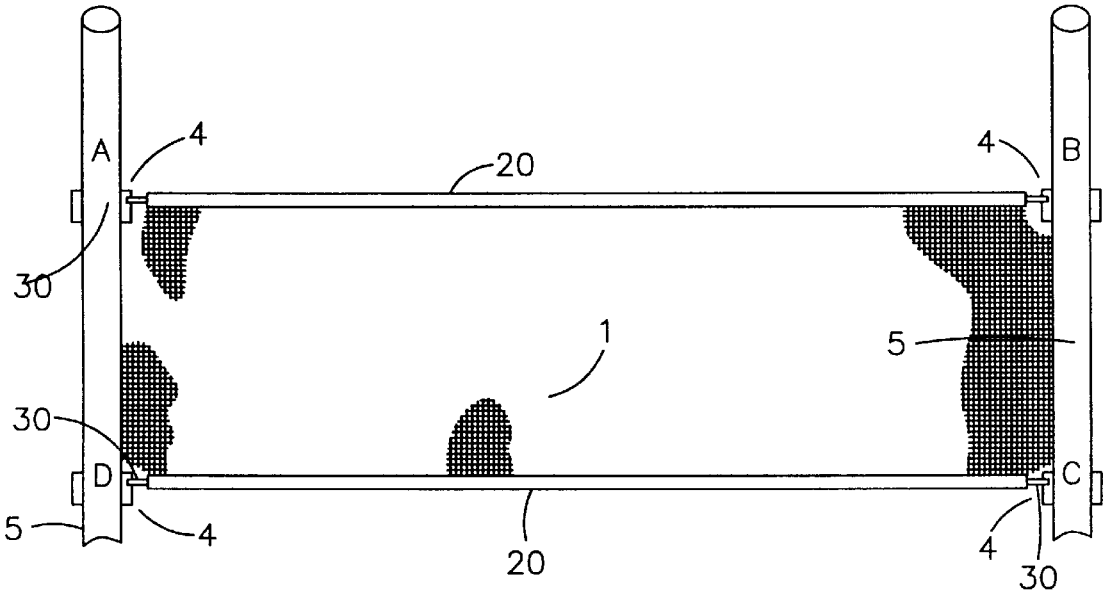
FIG. 2 is a partially fragmentary elevation view of a panel mounted in place on a scaffolding system.

As seen in FIG. 2, the mesh 1 is adapted to be secured between two upstanding support members 5,5 of the scaffolding system. Each mesh panel 1 connects to the upstanding support members 5,5 and four given points a,b,c,d which gives the panels a highly stable and flat face appearance effect.

The system illustrated generally as 2 is disclosed for use in a new and unobvious application for a decorative pr debris barrier material on a scaffolding system. Each mesh panel is highly simplified having the mesh material 1,1, at least two ratchets, 36 or 60, and a border 20,20' which is connected to the mesh panel in a manner as will be discussed herein.

Figure 3:
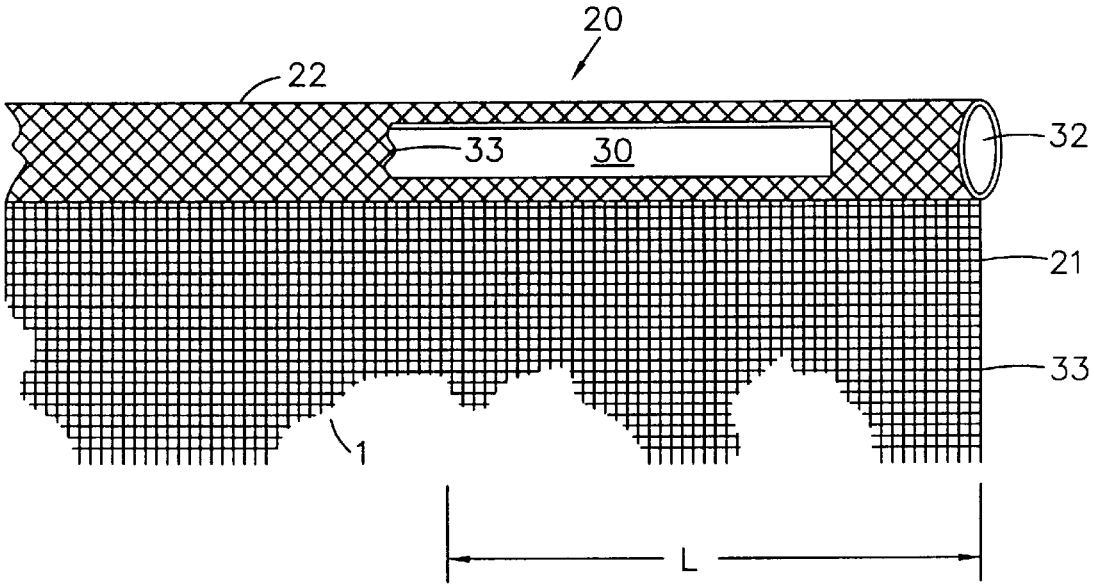
FIG. 3 illustrates a partially fragmentary elevational view of a first embodiment of a panel of the present invention showing the free end corner which is adapted to be received within a ratchet device.
Figure 4:
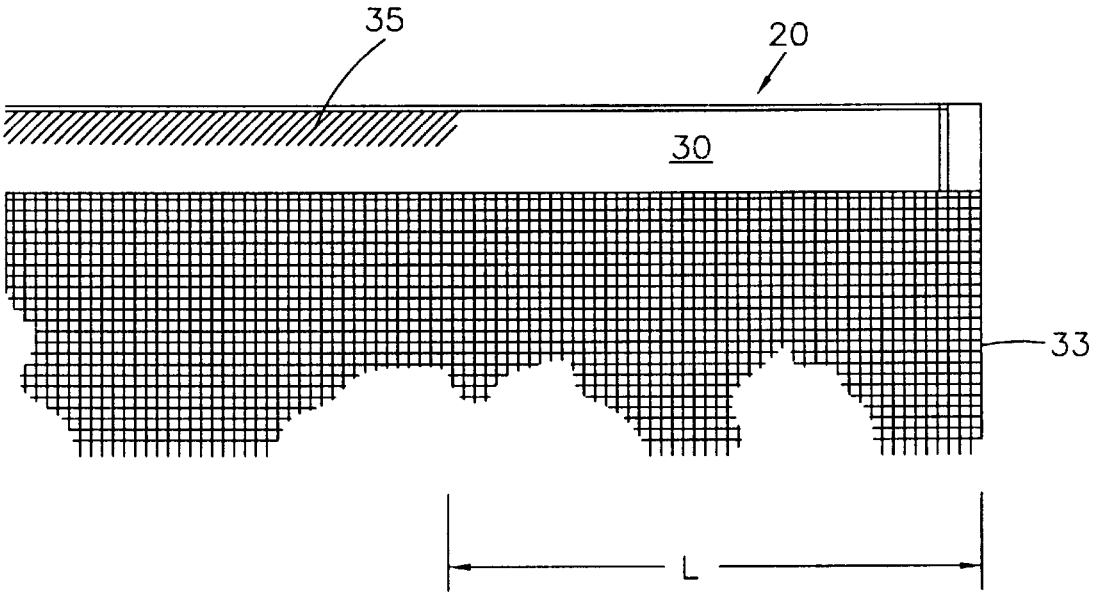
FIG. 4 illustrates a partially fragmentary elevational view of a second embodiment of a panel of the present invention showing the free end corner which is adapted to be received within a ratchet device.

Referring now to FIGS. 3 and 4, and to the methods by which the webbing is attached to the panel, it should be seen that in FIG. 3, the mesh panel 1 is connected to the border through a flat braided rope 20 which is sewn to the mesh thereby allowing the webbing to slide within the flat braid rope, while in FIG. 4, the webbing is connected directly to the mesh.

Figure 9:
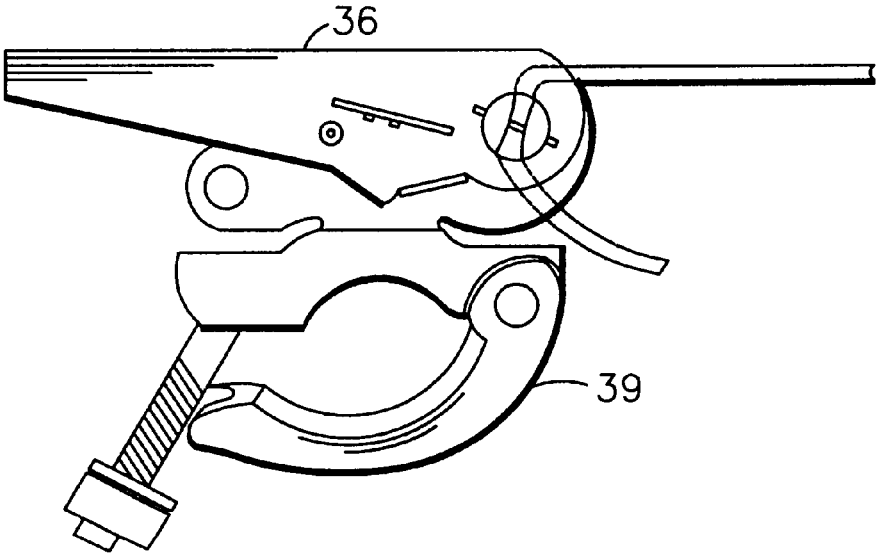
FIG. 9 illustrates in side elevation view the ratchet of FIG. 8 usable with the mesh of the types illustrated in FIGS. 4 and 5.
Figure 10:
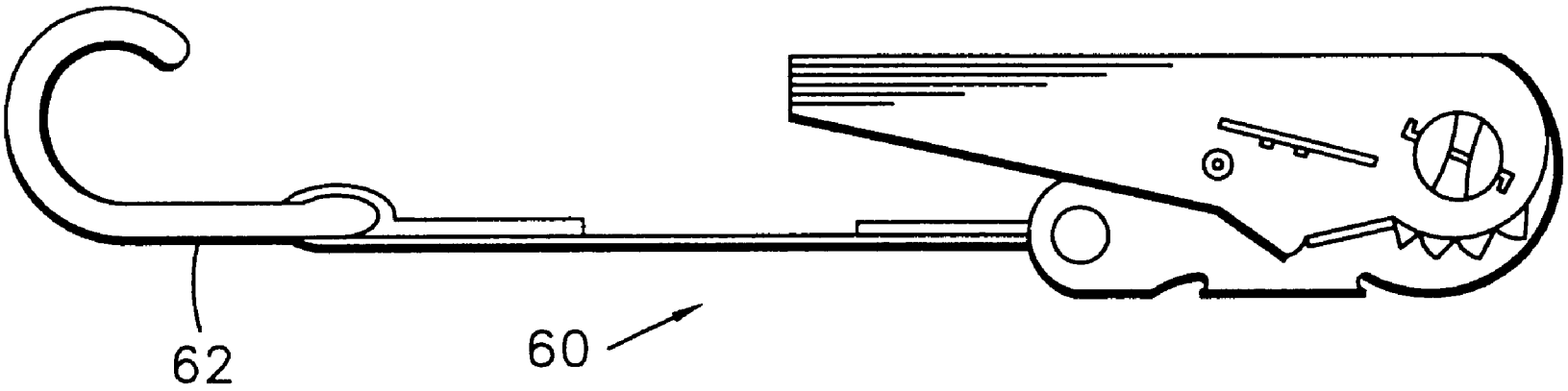
FIG. 10 illustrates a side elevation view of a ratchet device adapted for use with the panel illustrated in FIG. 5.
Figure 11B:
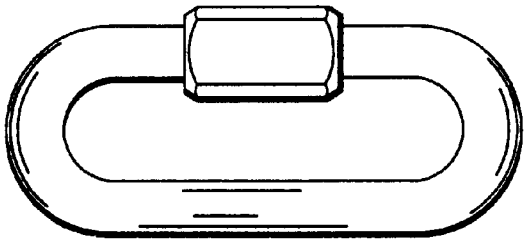
FIGS. 11*a*, 11*b* 11*c* and 11*d* illustrate hooks which connects the panel illustrated in FIG. 5 with the ratchet illustrated in FIG. 10.
Figure 11D:
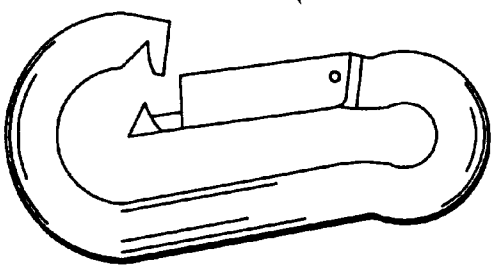
Figure 11A:
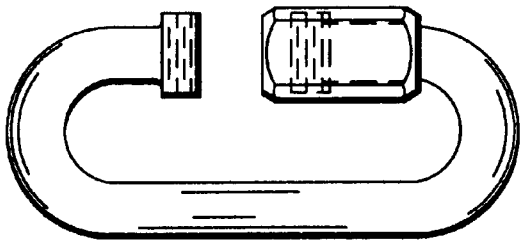
Figure 11C:
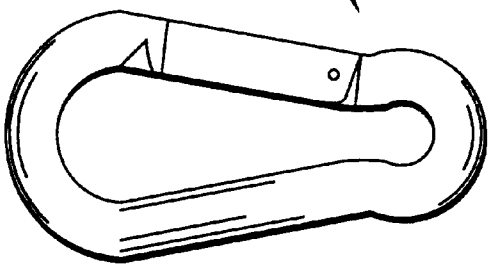

At the support members 5,5 are mounting connections 4,4 which connect the mesh to the structural members. The mounting connections 4,4 as illustrated in FIGS. 9, 10 and 11 can be integrally formed with a ratchet device, or alternatively can be separate members which connect the mesh with the scaffold as a separate element, such as by using a threaded member which pierces the mesh panel and thereafter threads into the transverse side of the scaffolding member. Alternatively, such separate connecting member may take the form of a tie wrap. The number of such mounting connections 4,4 are numerous along the length of each support member, and therefore as between successive such mounting connections, the mesh panels 1,1 are attached in regular or irregular patterns, depending on the desired effect.

As seen in FIG. 1, the mesh is a panel of fine-mesh fabric which takes on an opaque appearance when viewed from a distance to give a desired flat panel solid form when viewed from the outside and from afar. The mesh 1 is made from a color-fast material giving it color capability which can be coordinated with the environment it is being used in. Also, as seen in FIG. 1, each panel may be connected at spaced intervals to the scaffolding 7 to create a desired geometric pattern which goes with the architectural design of the structure. It should be noted here that the more open the mesh is, such as found with the debris mesh 11 in FIG. 1, the less visible the mesh is, but does reduce wind loads.

In the preferred embodiment, the mesh material 1 is desirably manufactured from 9×8, #18K flexible foamed PVC 1000 denier polyester, with minimum fabric weight of 9–10 oz. Per square yard, meet a minimum tensile strength, warp: 170 lbs/inch, fill: 155 lbs/inch minimum. Minimum tear strength, warp: 58 lbs., Fill: 55 lbs. (ASTM D2261-96). Fabric stretch, 27 lbs/inch; warp, 4 percent maximum; fill, 4 percent maximum; caliper, 45–50 mils. UV resistance, 1000 hours QUV exposure (ASTM G53096). Minimum fire retardancy: Federal Standards 191, method 5903.2 vertical 55 lbs/inch minimum. Color: Grayblue 18MW.

The 9×8 mesh 1 is a commercially available product which is sold by BO-Tex Sales Corporation, 175 Industrial Road, Hogansville, Ga. 30250. The mesh fabric is comprised of 22% high tenacity polyester yarn and 78% flexible foamed PVC. The yarns are intimately bonded at the crossover points and the degree of openness is dependent on the fabric construction. Known mesh applications are for windscreens, horticultural shading in greenhouses and outside areas, personal sunscreen, and in the fabrication of outdoor stage sets. The following are more specific characteristics of the mesh which is used in the preferred embodiment.

| | |
|---|---|
| Construction: | 9 × 8 ends/inch |
| Coating: | Flexible Foamed PVC |
| Core Yarn: | 1000 denier Polyester |
| Fabric Weight: | 9–10 oz/sq. yd |
| Tensile Strength: (ASTM D-1682) Grab | Warp: 170 lbs/inch minimum<br>Fill: 155 lbs/inch minimum |
| Tear Strength: (ASTM D-3786) Tongue-single rip | 58 lbs minimum warp<br>55 lbs minimum fill |
| Mullen Burst Strength: (ASTM D-3786) | 265 lbs/sq. in minimum |
| Caliper: (Fabric thickness) | 45–50 mils |
| Fire Retardancy: | As required. Mill run fabric is self extinguished in horizontal burning mode. Increased fire retardancy can be special order to meet specified tests. |

-continued

| | |
|---|---|
| Cold Crack: 2° mandrel | No cracking after 24 hours @ 40° F. |
| Fabric Stretch: (ASRM D-1628, 27 lbs/inch) | Warp 4% maximum<br>Fill 4% maximum |
| UV Resistance: (ASTM G-53) | 1000 hours QUV exposure-slight color deterioration |
| Shade Factor: | 80% (78–82%) |

The mesh 1 in another embodiment can be comprised of yarn of 1,000 denier polyester running in a vertical direction as illustrated by elements and two 500 denier yarns running in a horizontal direction. The yarns are similarly coated by using a highly flexible foam PVC. It is the coating of the yarns which allows the material to be highly supple and flexible and soft to the touch. The below Table A illustrates the specific characteristics of the material. Also, the material is also sold by BO-Tex Sales Corporation, 175 Industrial Road, Hogansville, Ga. 80250, under part number BO-LOC7X5.

TABLE A

| | |
|---|---|
| Construction: | 7 × 5 ends/inch |
| Coating: | Flexible Foamed PVC |
| Core Yarn: | 100 denier Polyester |
| Fabric Weight: | 6.5–7.5 oz/sq. yd. |
| Tensile Strength: (ASTM D-2261) Tongue-single rip | 45 lbs. minimum warp<br>35 lbs. minimum fill |
| Mullen Burst Strength: (ASTM D-3786) | 257 lbs/sq in minimum |
| Fire Retardancy: | Afterflame: Less than 3 seconds (typical) |
| (Fed. Std. 191, Method 5903.2, Vertical) | Char Length: Less than 4 inches (typical) |
| Cold Crack: | No crackinq after 24 hours @ −40° F., 2" mandrel |
| UV Resistance: (ASTM G53) | 1000 hours QUV exposure - slight color deterioration (Not applicable for fluorescent colors) |
| Specific Gravity: | 0.60 |
| Colors Available Upon Request | |

Referring now to FIGS. 2–4, 8 and 9, it should be seen that the mesh panel shown in this embodiment includes a border member 20 which in the case of the embodiment shown in FIG. 3 includes an upper and a lower pocket member 22 which are attached to the upper and lower edges of the mesh 1 by folding over a length of the mesh on itself and stitching it along line 21. The pocket member 22 is a tubular member having an internal chamber 32 into which is received a web 30 which is somewhat free to slide therein, but is dimensioned so that it is tightly fitted within the internal chamber 32. The pocket member 22 takes the form of a hollow flat braid rope, such as disclosed in copending U.S. patent application Ser. No. 08/789,416 filed Jan. 29, 1997 and Entitled Flat Braid With Web Core, which is hereby incorporated by reference and the webbing 30 is of the type disclosed in same application as well. Thus, the mesh can be pulled tautly horizontally in the direction of the free ends of the web 30, when the web is pulled tautly itself.

It should be understood that the above types of materials are those which are disclosed by way of the preferred embodiment, but numerous substitutions may be had; such substitutions for the mesh material 1 may further be found with reference to the fine mesh material disclosed in the aforementioned copending U.S. application Ser. No. 09/012,472, entitled, Method of Using Barrier Material and System, filed Jan. 22, 1998 under EXPRESS MAIL No. EM174706093US.

Figure 8:
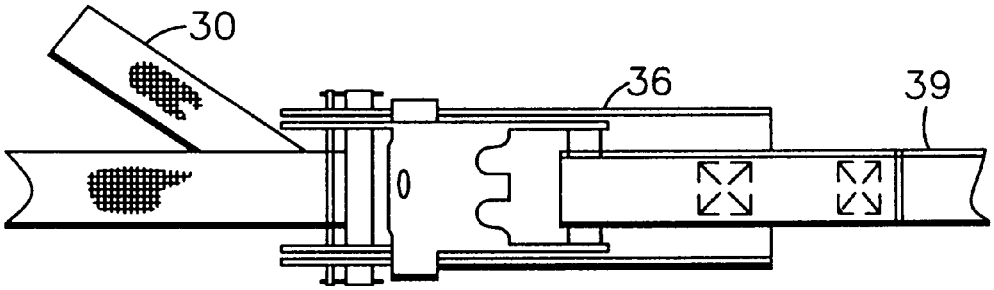
FIG. 8 is a partially fragmentary view illustrating a ratchet device with a panel web received therein.

Referring now to FIG. 4, it should be seen that the mesh panel shown in this embodiment is essentially the same as that disclosed in FIG. 3 above, except that the border member 20 is comprised solely of a web length 30 which is serge stitched at 35 substantially along its length. It should be appreciated from the illustrations in FIGS. 3 and 4 that the rightmost edge 33 of the mesh panel 1 extending inwardly therefrom a distance of about the length L is left unattached to the web 30. While in the embodiment of FIG. 4, the mesh stitching 35 is simply stopped along length L, it should be understood that in the case of the embodiment shown in FIG. 3, the web 30 at point 33 is caused to pierce through the pocket member 22 and through the folded over sheet of mesh 1 in order to orient the web outside the panel in a side-by-side orientation with it. In this way, the distal ends of the web are allowed to be fed directly into a ratchet 36 in the manner illustrated in FIGS. 8 and 9 without interference from the corresponding length of mesh material. As illustrated in FIG. 9, each ratchet may have an integrally formed clamp 39 allowing it to be connected in a perpendicular relationship with the elongate extent of the scaffolding columns 5,5 to thereby receive the horizontally extending web 30 therein. Alternatively, as seen in FIG. 8 a strap 39 may be used to secured the ratchet to the support 5.

The length L of mesh material which is left unattached to the terminal ends of the web 30 may therefore be wrapped around the scaffolding columns to render a desired on the scaffolding, and thereby maintaining a flat form of the mesh across two scaffolding members 5,5.

Figure 7:
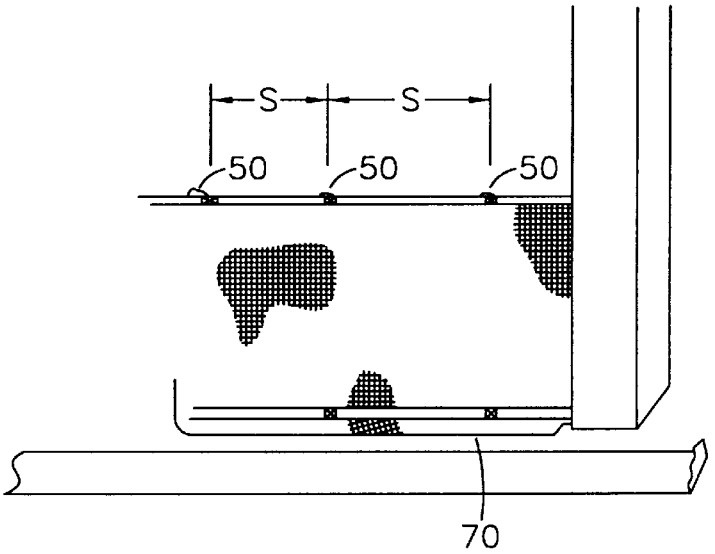
FIG. 7 is a partially fragmentary view of the panel illustrated in FIG. 5 in an assembled condition, and attached to a structural member, such as a column.
Figure 5:
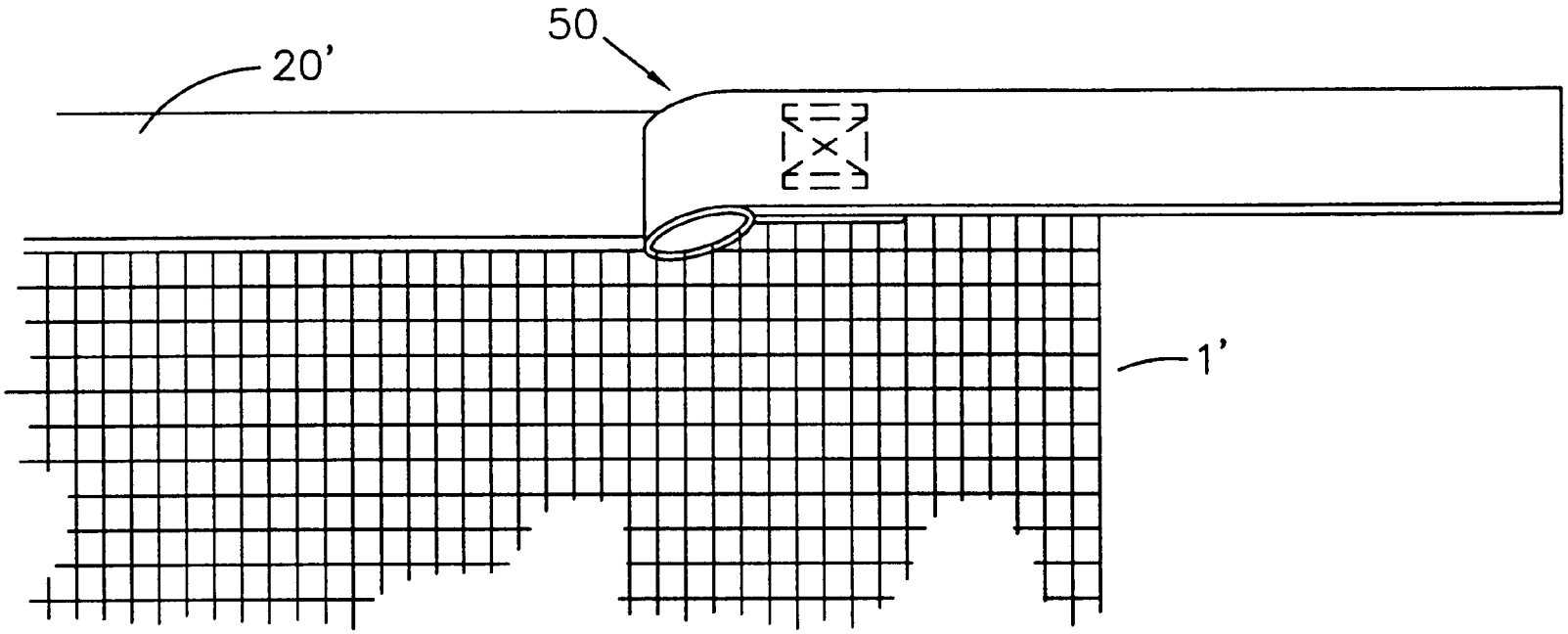
FIG. 5 illustrates a partially fragmentary elevational view of a third embodiment of a panel of the present invention showing the free end corner which is adapted to be received by a ratchet device.
Figure 6:
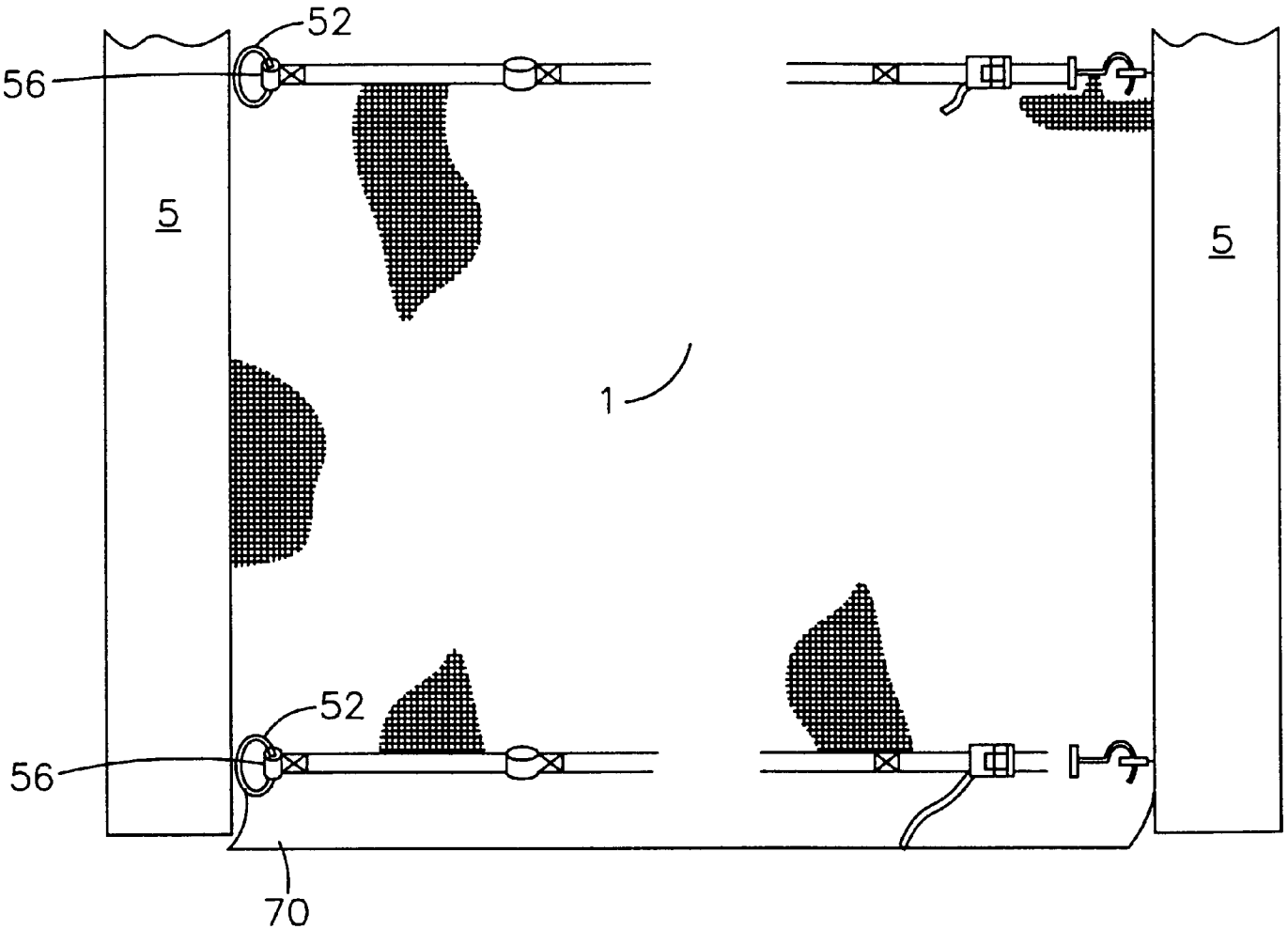
FIG. 6 illustrates the reverse side of the panel shown in FIG. 7 using a panel of the type illustrated in FIG. 5 as connected to a scaffolding system.

Referring now to FIGS. 5, 6 7, 10 and 11*a* –11*d*, it should be seen that as an alterative to using a border member which is sewn substantially along the entire length of the mesh as depicted by element 20 in FIGS. 3 and 4, the mesh panel 1' in FIGS 5–7 employs a border 20' which is formed from a strip of webbing which is doubled back on itself at intervals, S,S to create a series of loops 50,50. The loops 50,50 are box stitched to the mesh panel material 1' at the intervals S,S such that the web material 20' which extends therebetween, e.g. along interval S,S, remains unattached to the mesh panel. In this way mesh material which is cut from a roll of stock material transversely of its length, i.e. of the borders 20', between the loops 50,50, will automatically be provided with a means for connecting the panel to a ratchet at one end and at the other end thereof to the scaffolding or concrete column, as illustrated in FIG. 6 or 7.

As illustrated in FIGS. 6 10, and 11, to each of the scaffolding columns 5,5 is attached a hook 52 such as shown in FIGS. 11*a* –11*d*. These hooks may connect to a threaded eye bolt 56 which threads into the transverse side of the columns 5,5. when the stock mesh material is cut adjacent to a loop 50 it allows one end of the panel to be fit closely adjacent the leftmost column 5. However a certain amount of excess can be allowed to extended beyond the loop 50 end in order to wrap around the column if desired. Thus using a hook 52, the loops 50 connect the panel to the support 5 at one side, which in the illustrated example is the left side.

On the opposite side of the panel it is desirable to cut the panel such that a length of the border 20' is left so that it may be fed through a ratchet such as shown in FIGS. 8 and 9. However, it is also possible to use the loop 50 which is immediately adjacent the rightmost column as a fastening point for connecting directly to a ratchet such as shown in FIG. 10 at 60. The ratchet 60 has a curved arm 62 which is displaced by the ratchet mechanism to take in the border 20' when it is actuated. Thus, the curved arm 62 may be inserted into the loop 50 to make the connection between the support 5 and the mesh, or a hook 52 can make a splice connection between loops 52,52 in order to overlap the mesh of two panels and eliminate an opening therebetween.

Referring again back to FIG. 1, it should be seen that the mesh panel 1 is comprised of a series of interconnected vertically and horizontally extending individual mesh panels which are connected in an end to side manner. The vertical and horizontal panels are referenced hereinafter as designated respectively by as members 1V and 1H.

Figure 12:
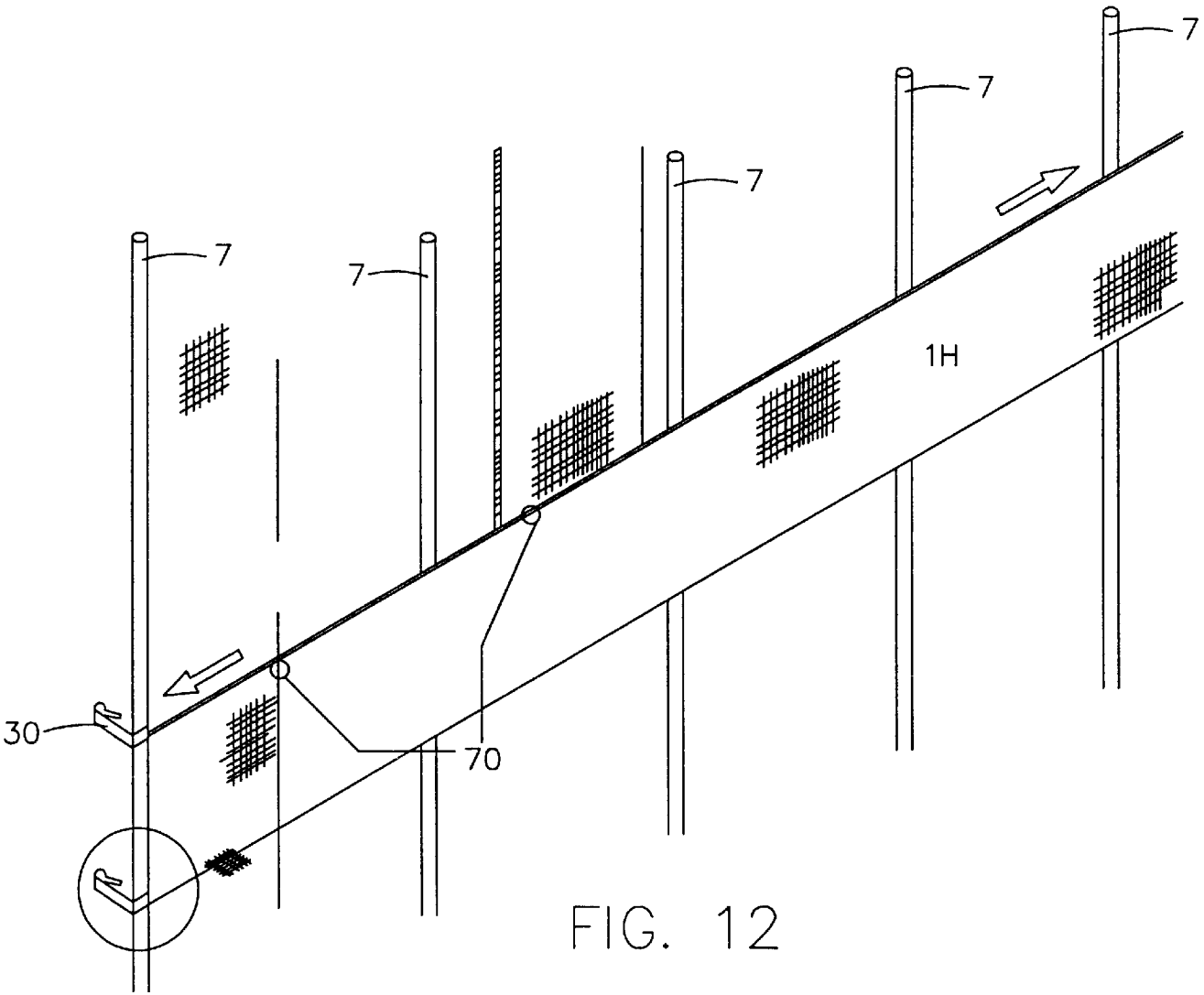
FIG. 12 is a partially fragmentary perspective view of the vertical horizontal panel system of the present invention.

As illustrated in FIG. 12, the vertical scaffolding members 7 extend parallel to the vertical panel members 1V and perpendicular to the horizontal panel members 1H. As can be seen from the generally schematic view of FIG. 1, the panel system is created through the intermediary of a seam 70 which connects panels 1V and 1H to one another. The seam 70 is best illustrated in FIG. 14*a* wherein it can be seen that the seam 70 is generally imperceivable as viewed from afar giving the panel system a desired uniform and continuous look.

Figure 13:
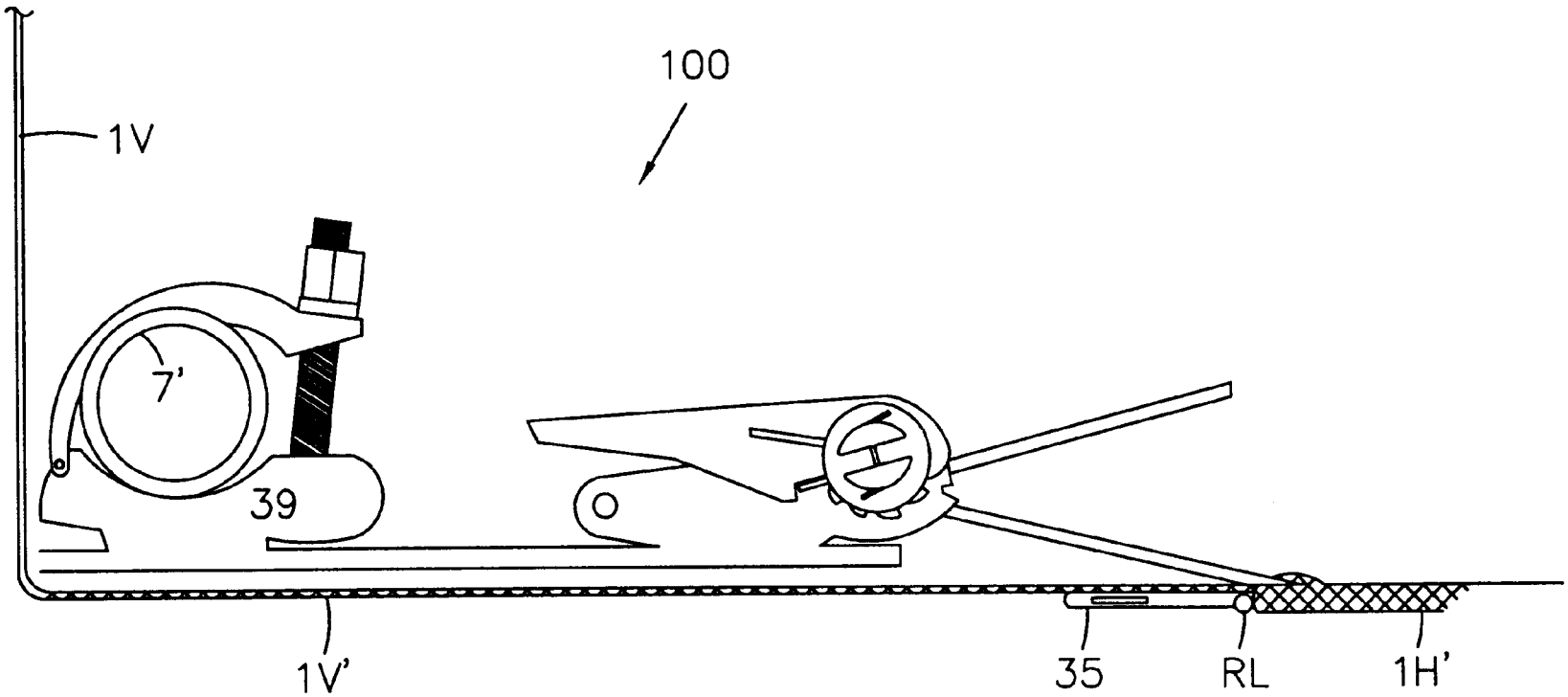
FIG. 13 is a horizontal sectional view showing a corner connection of the system.
Figure 14:
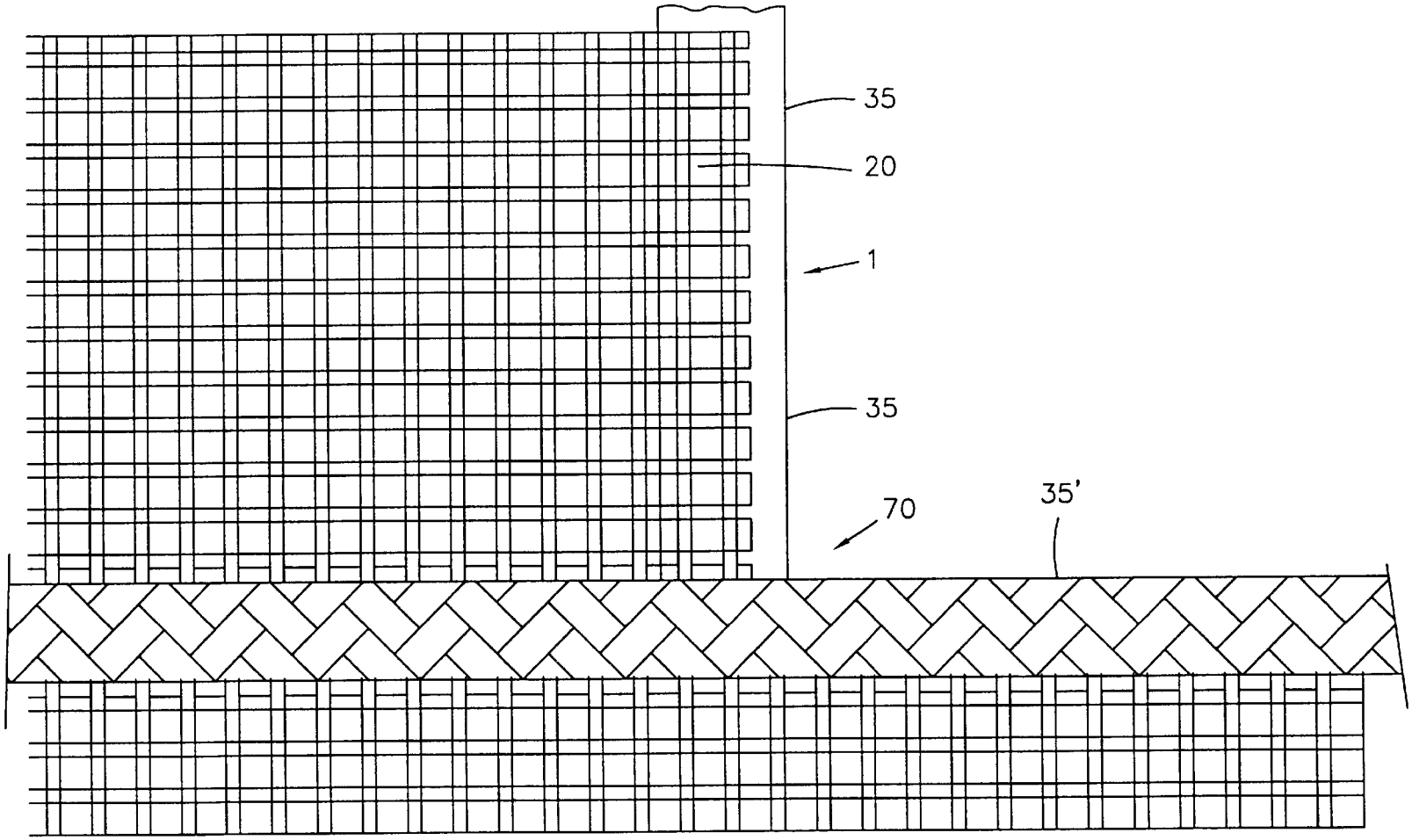
FIG. 14 is a detailed view between a vertical and horizontal panel section as seen from the front.

The mesh panels shown in FIG. 14*a* are generally of the type such as disclosed and discussed with reference to FIG. 4 above. That is, each panel has piercible web 30 that is surge stitched at 35. In the embodiment illustrated in FIG. 13, the serge stitching can be seen on the outside face of the panels, leaving the webs 20,20 to be internally disposed. More specifically, from FIG. 14*a* it can be seen that the surge stitch 35 extends along the vertical sides of the panel 1V while serge stitch 35' is shown extending horizontally along panel 1H. Thus, as illustrated in FIG. 4, the side on which the webs 20,20 are contained is the inside face of the panel system 1, leaving each panel outside face as a generally smooth exterior surface.

Figure 15A:
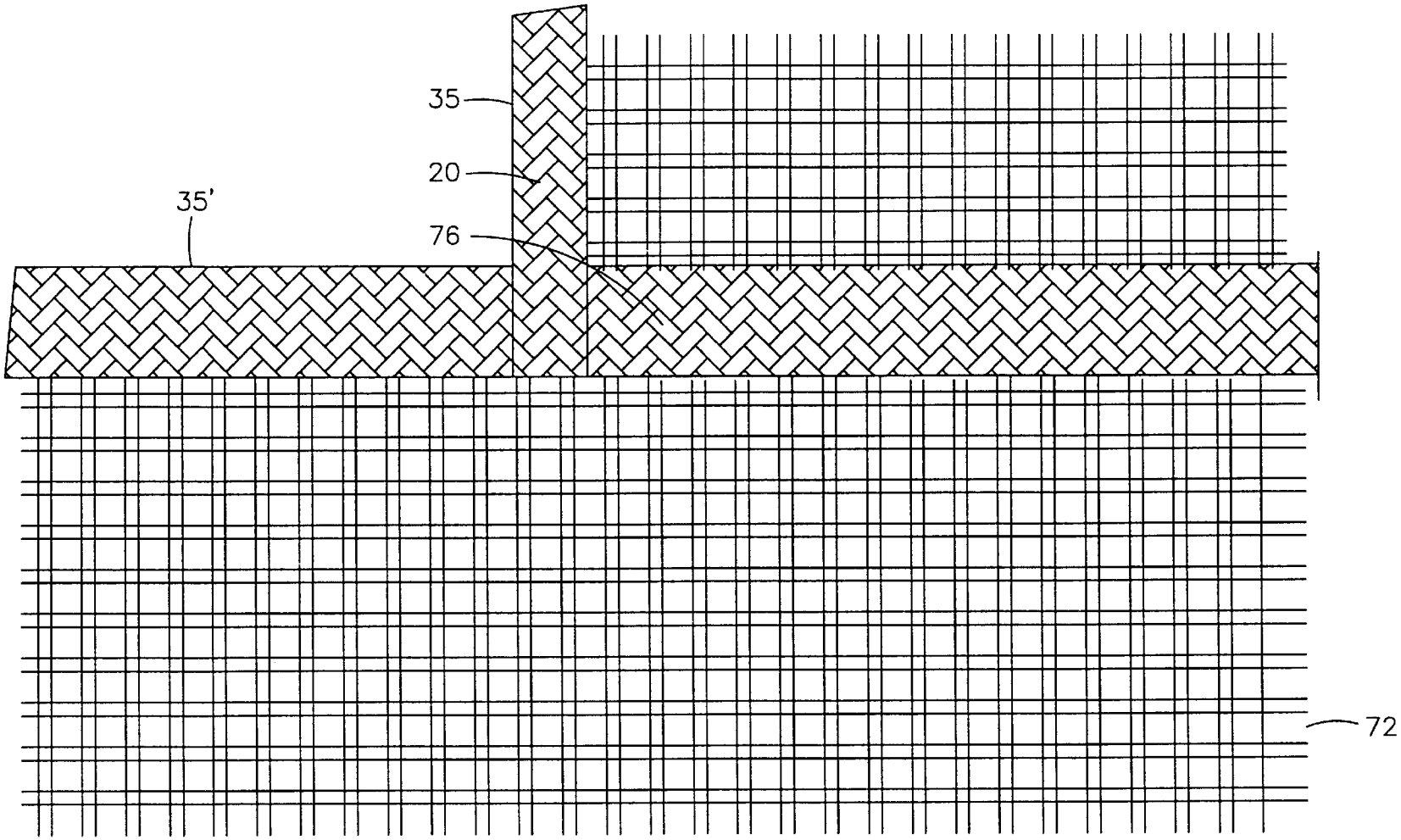
FIG. 15*a* is a view of the connection shown in FIG. 14 as seen from the rear.
Figure 15B:
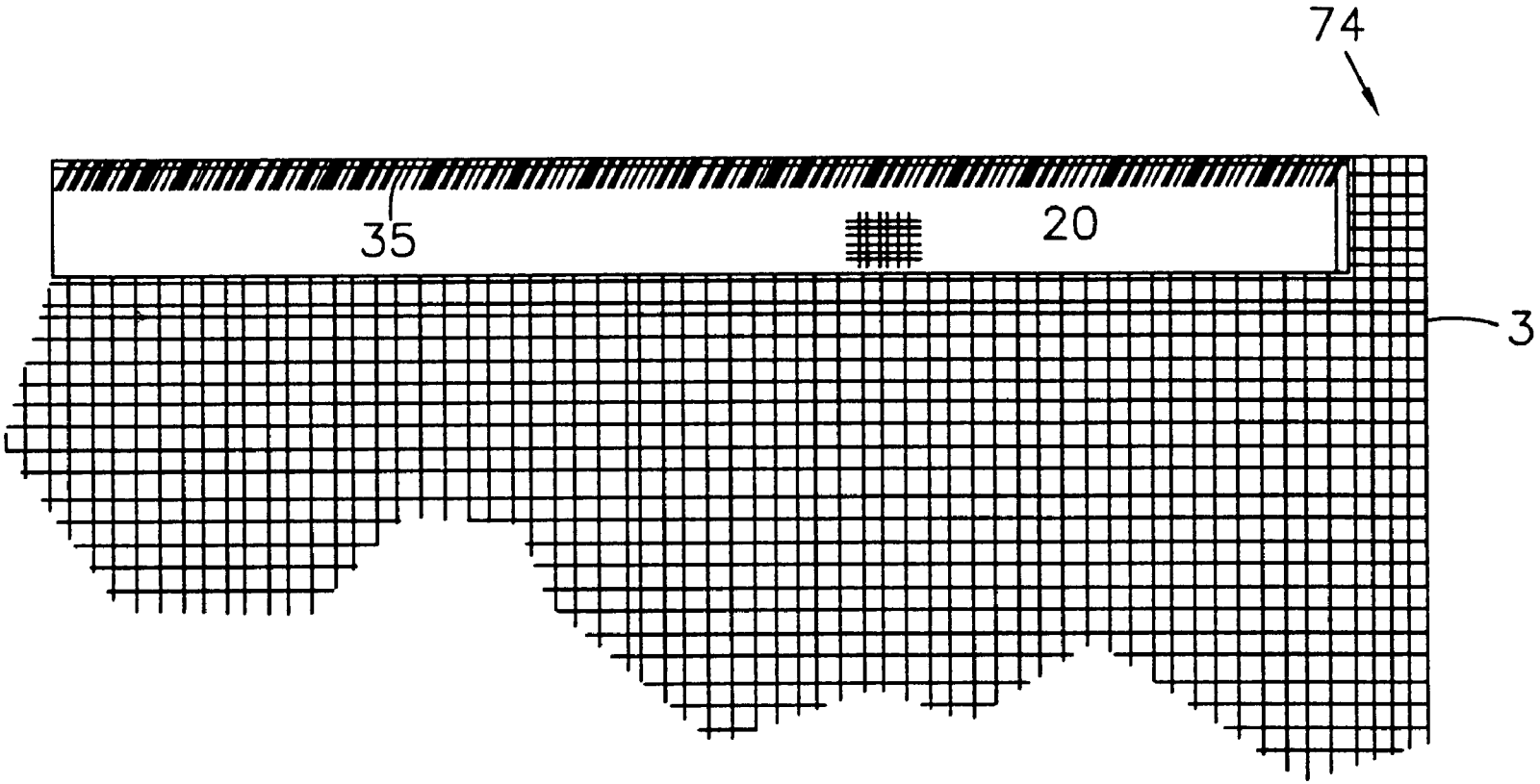
FIG. 15*b* is a view of an alternative form of the panels.

As illustrated in FIG. 15*a*, the vertically extending panel 1V has a lower horizontal border 20 stitched completely to the edge E. Thus at the edge E is disposed a sewn serge stitched border 72 which, in the illustrated embodiment, takes the form of a sewn bead-like stitch extending along its length. Alternatively, as shown in FIG. 15*b*, the panel may have an unbordered length 74 which is sufficient to be rolled about itself in a cylindrical manner to create an elongated bead-like form which is capable of running lengthwise in coincidence with the border 20'/35' of the horizontally extending panel 1H.

Figure 16:
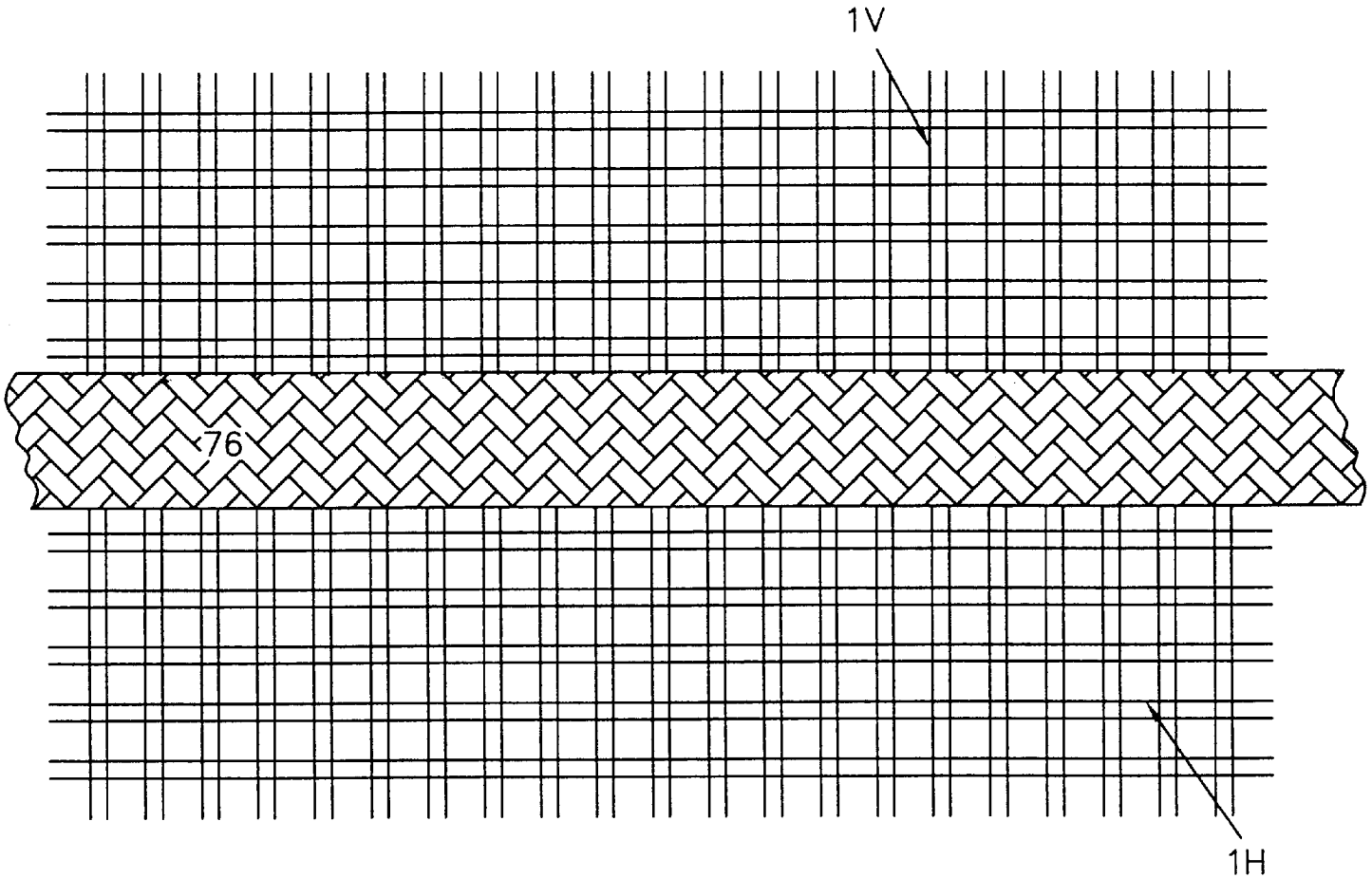
FIG. 16 shows the connection between panel members in a T-connection.
Figure 18:
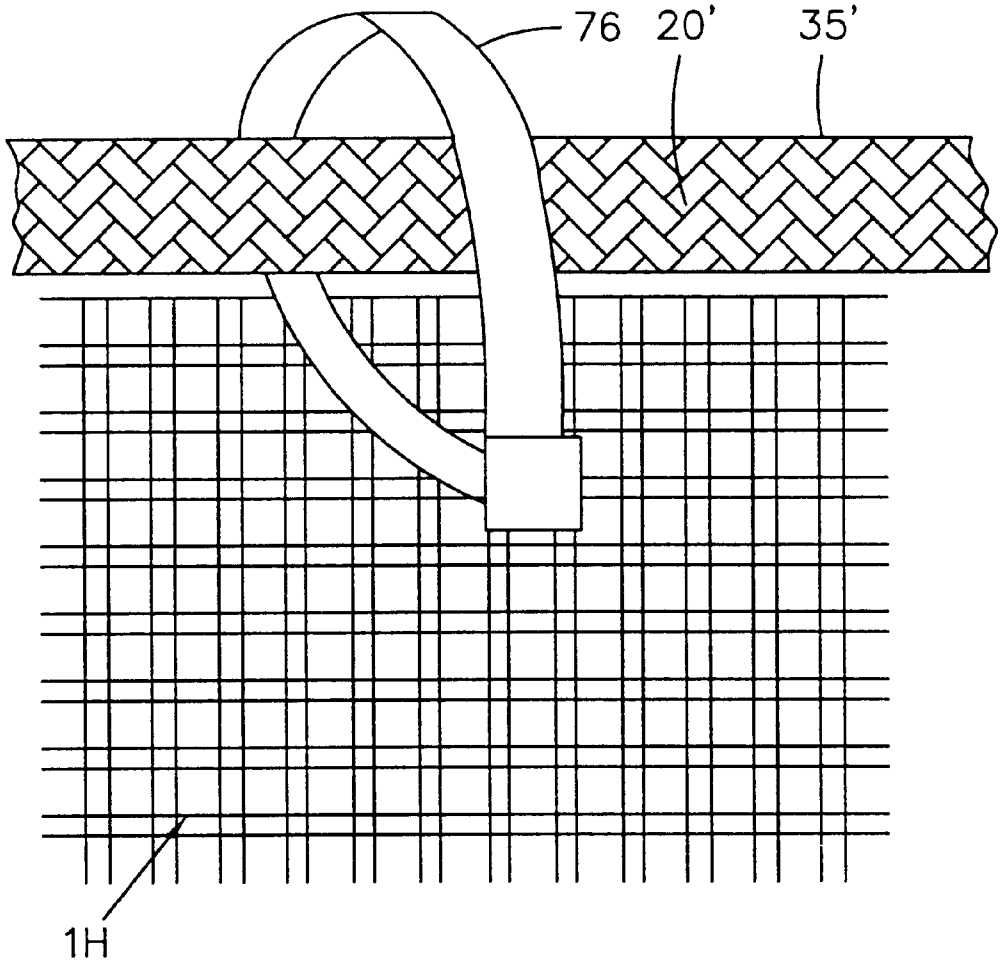
FIG. 18 shows a typical tie wrap used for the connection of FIG. 16.
Figure 19:
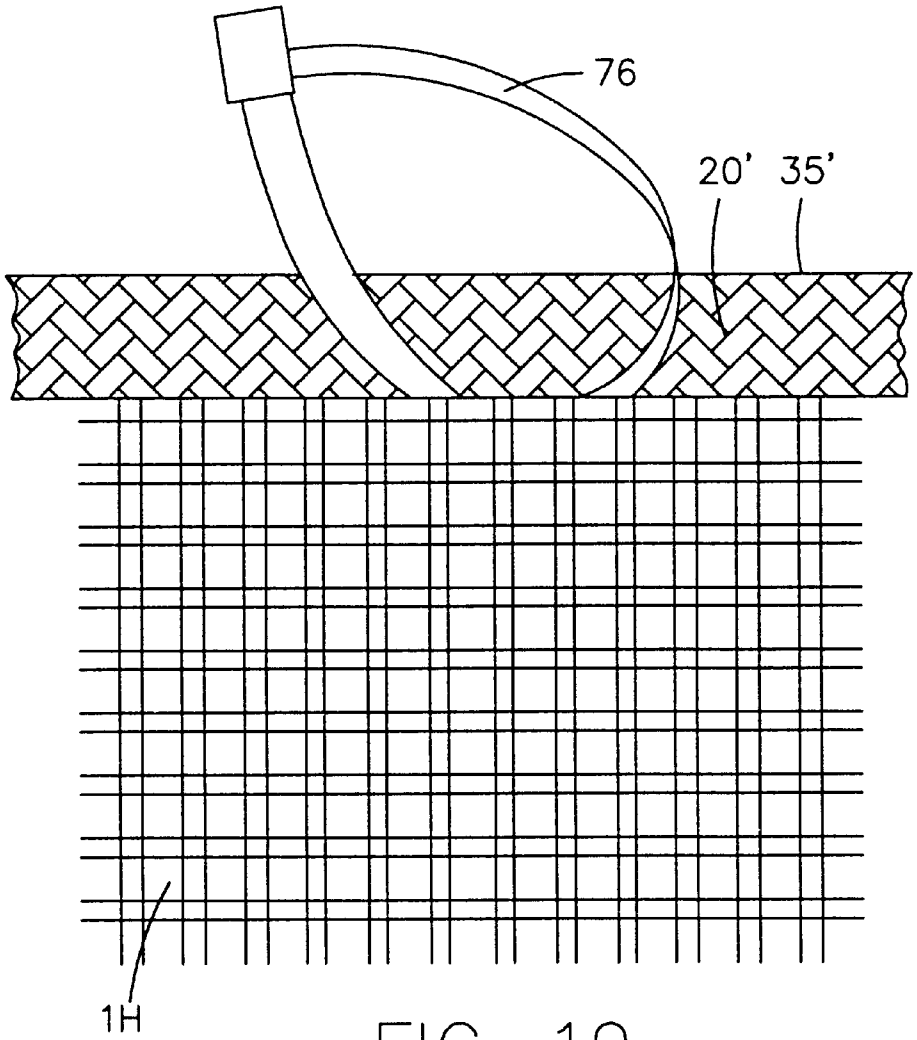
FIG. 19 shows a tie wrap within the border of a horizontally disposed panel member for the connection of FIG. 17.

Referring now for the moment to FIGS. 18 and 19, it should be seen that the border/web 20' which is carried by the panel 1H is capable of being readily pierced by a standard plastic tie wrap which is readily commercially available and is illustrated generally as numeral 76. In the embodiment illustrated the tie wraps are sold by PANDUIT at 17301 Ridgeland Av. Tinley, Ill. 60471. Each tie wrap 76 creates a loop which can be threaded through the mesh of the adjoined panel and about either the beaded sewn border 72, or the rolled border length 74, or through side by side laid ones of the webs 20, 20 at the spatially uniform locations as best illustrated in FIGS. 15*a* and 16.

Figure 17:
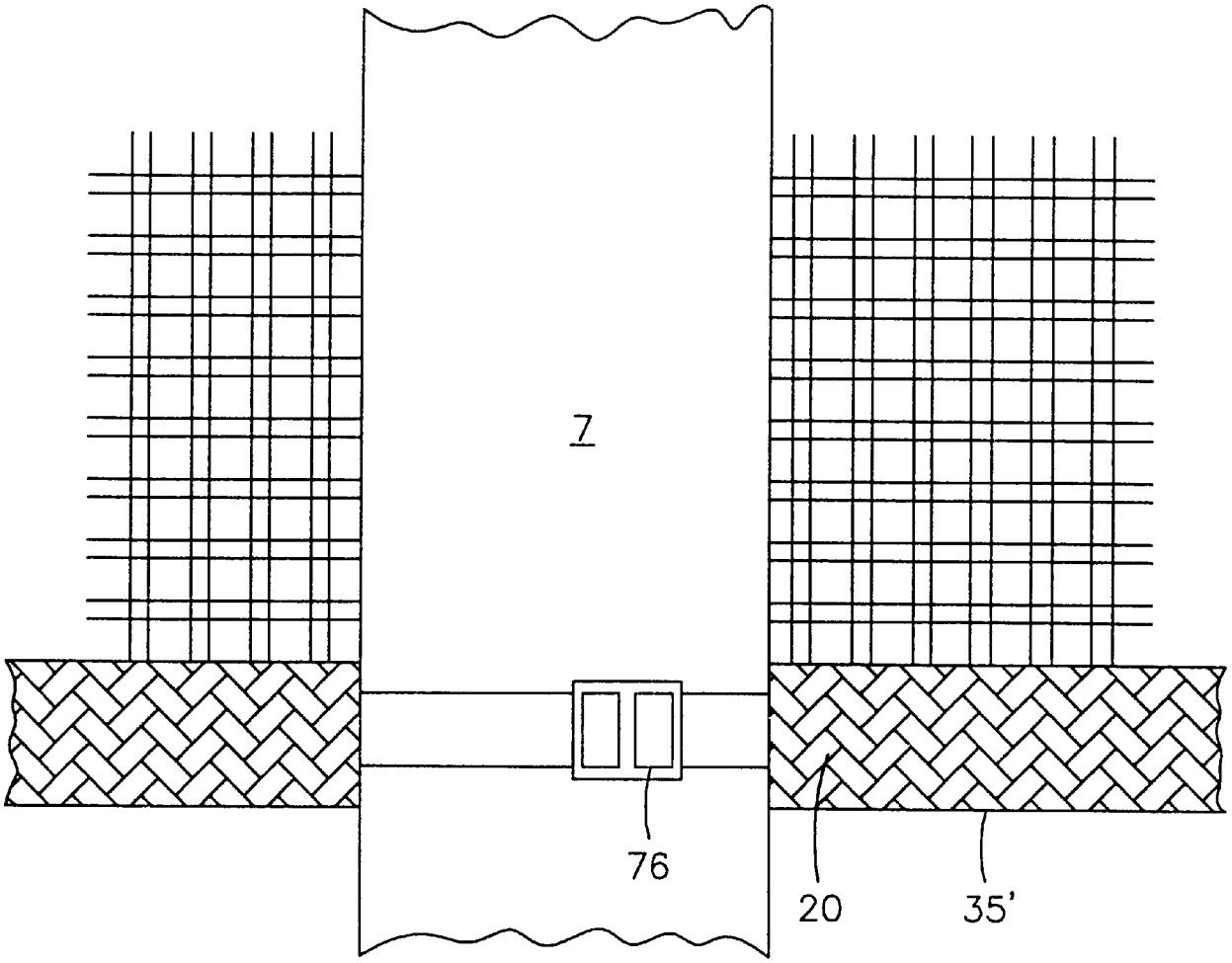
FIG. 17 shows a connection at a scaffolding member to the mesh border.

As illustrated in FIG. 12, it should be seen that the horizontal panel member 1H which extends between several of the vertically extending scaffolding members 7,7, is further capable of being connected to it through the intermediary of a plastic tie wrap 76. This is best illustrated in FIGS. 17 and 19 wherein a tie wrap is threaded in a parallel orientation to the length of the panel and relative to the border 35' such that it can form a loop which will receive the perpendicularly extending scaffolding member 7.

Referring now to FIG. 13, and to a corner connection 100, it should be seen that a corner connection of the present invention involves a scaffolding post 7' incorporating a clamp and ratchet assembly such as discussed in FIG. 9 with respect to the clamp 39. Here it should be seen that the vertically extending panel 1V' has its borders 35,35 juxtaposed relative to the side edge of a horizontal panel 1H' which is of the type shown in FIG. 4.

Figure 21:
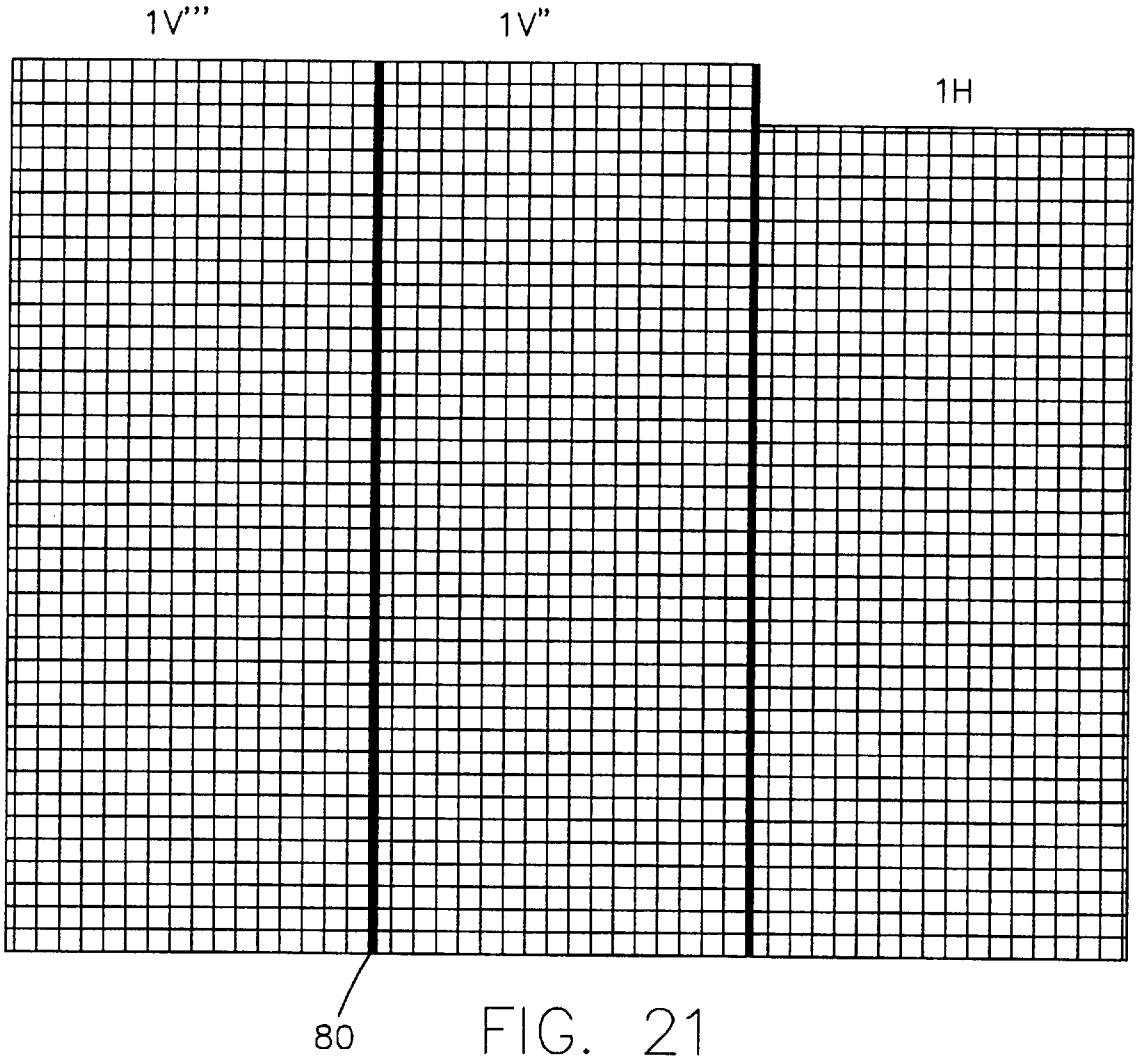
FIG. 21 shows the corner piece of FIG. 20*c* as seen from the front.

As previously discussed, the type of connection shown in FIG. 4 allows for a length L unattached mesh to extend coextensively generally with the border 20. The unattached length L is rolled in the embodiment of FIG. 13 to form a vertical column or tube RL which is placed side-by-side with the border 35 of the vertical panel 1V' and thereafter a tie wrap 76 is pushed through the border 35 of the vertically extending panel 1V' and through the roll RL of the length L of the panel 1H to effect a connection. Through a successive number of such connections, a tight end to end seam is created. However, as illustrated in FIG. 21, the flap portion L of the panel 1H can be simple tucked behind the vertically extending corner panel 1V' rather than being rolled and tie wrapped.

Figure 20B:
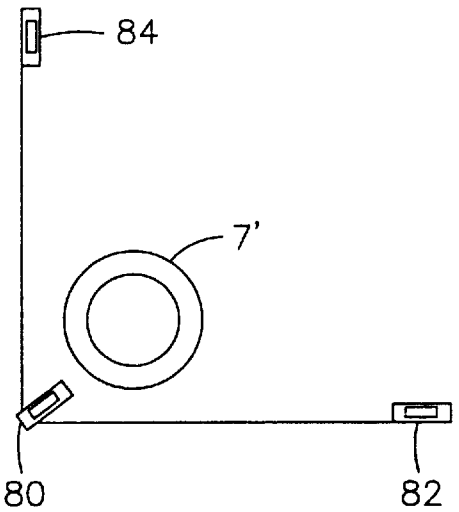
FIGS. 20*a*, 20*b* and 20*c* show a corner vertical panel connection.
Figure 20A:
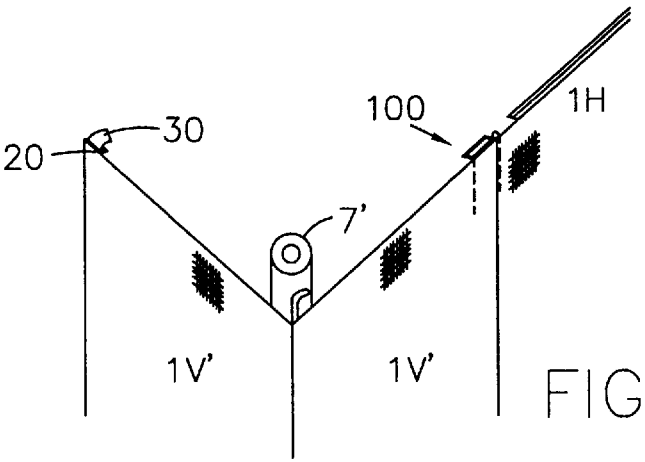
Figure 20C:
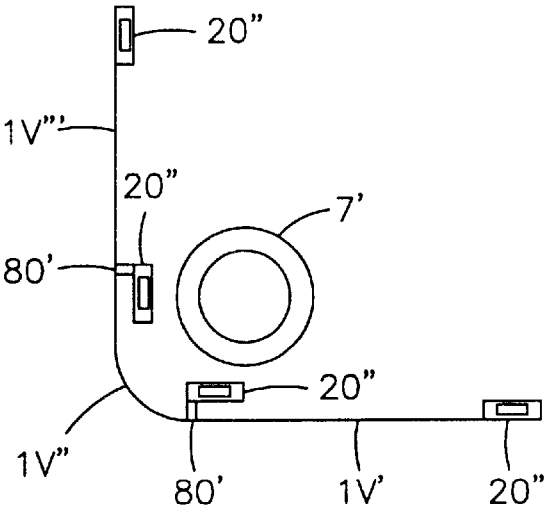

Referring now to FIGS. 20*a–c,* 21 and 22, it should be seen that a corner between two a vertically extending panels 1V', 1V', which may or may not include a horizontally extending panel 1H and the connection 100 shown in FIG. 13, can be effected at the corner scaffolding 7' as illustrated schematically in FIGS. 20*a* –20*c*.

Figure 22:
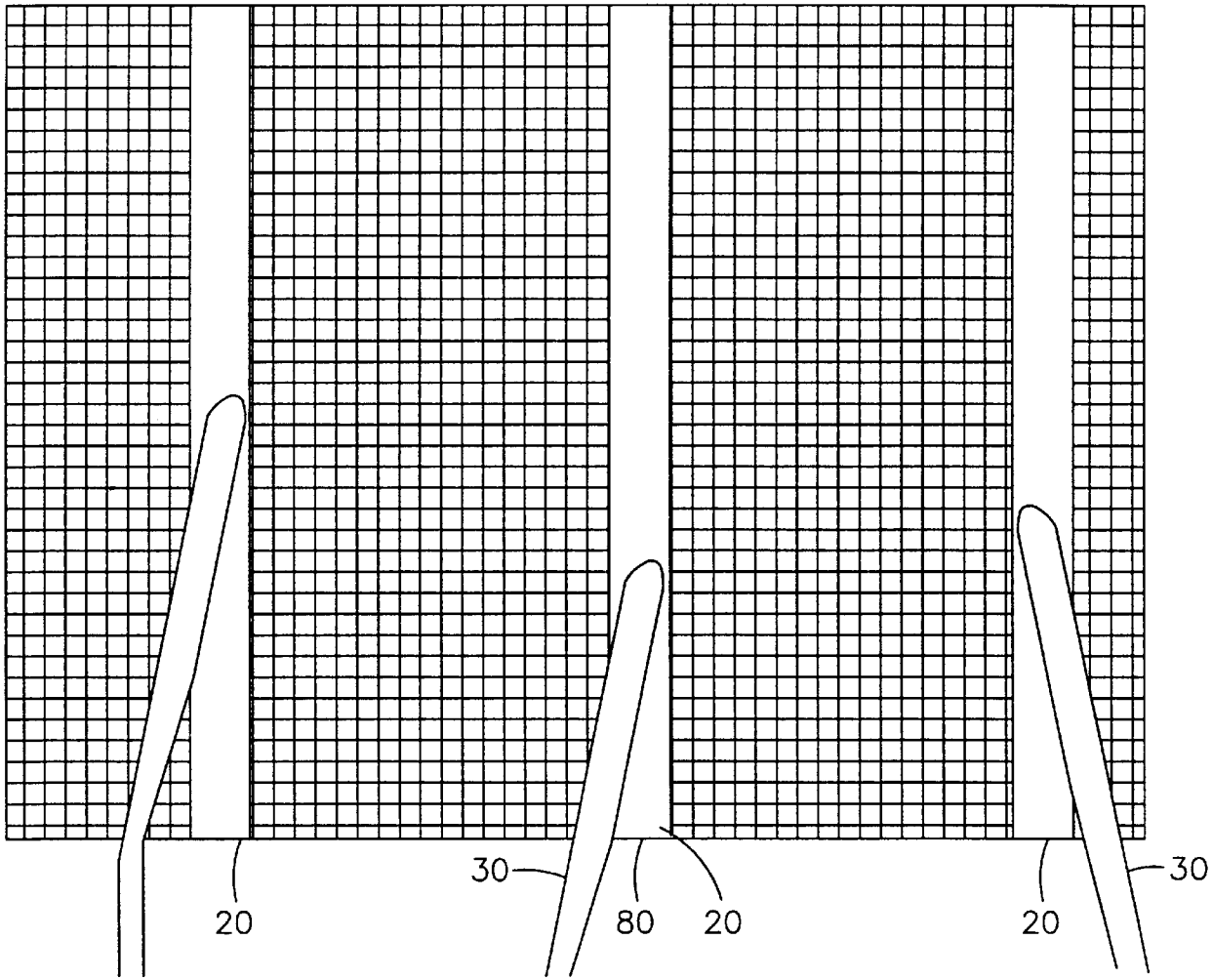
FIG. 22 shows the corner piece of FIG. 20*c* as seen from the rear.

As shown in FIGS. 20*a*–20*c*, at least two vertically extending panels 1V', 1V' with their webs 20/20 or 20/72 can be placed side-by-side with one another and connected via the clips 76,76 to create a corner piece with a symmetrical seam illustrated as 80 in FIGS. 20*a* and 22. The remaining borders 82, 84 as seen in FIG. 20*a*, may connect in a manner similar to that discussed in FIG. 13 with respect to the connection of a horizontally extending panel 1H'. Alternatively, as illustrated in FIGS. 20*c*, 21, and 22, the vertically extending corner piece can be made up of a plurality of short width vertically extending panels 1V',1V' which can be connected side by side via ties 76,76 or the like. Further, a single panel can be used with webs 20,20 sewn thereon in a parallel fashion as shown in FIG. 22.

Figure 23:
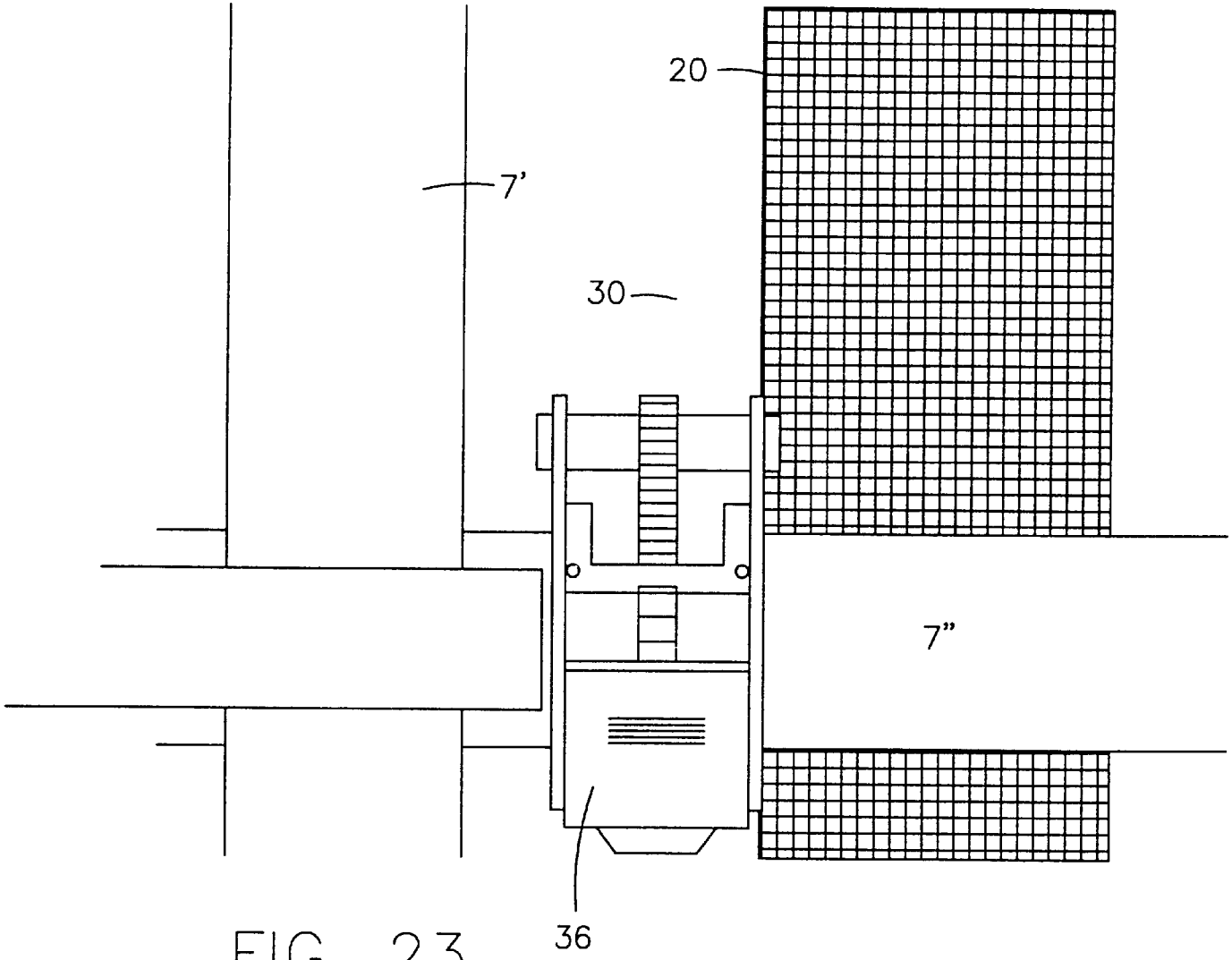
FIG. 23 shows a ratchet and scaffolding connection for tensioning the vertical corner panel shown in FIG. 22 as seen from the back side of the panel system.

Referring finally to FIG. 23, it should be seen that the vertically extending corner panel 1V', similarly has a webbing or strap 30 which can clamp to a horizontally extending scaffolding member 7" through the intermediary of a clamp ratchet 36 as discussed above.

The invention has been described by way of illustration rather than limitation. For example the reference to right left orientations has only been made for purposes of discussion and not limitation. Also, as seen in FIGS. 3 and 4, the border member and the mesh 1 cease to be connected along a length, L, associated with the free end portions of the panel. These free end portions of the panel act as a flap which may be independently secured to the column by wrapping around the column and connecting to itself. However, structurally, the panel connects to the columns via the border members which are sewn in place to the majority of the length of the panel. Additionally, as seen in FIGS. 6 and 7, the mesh panels 1, 1' may be oversized in length to allow for a horizontally disposed flap 70 to exist where needed, such as at the juncture of a deck.

Accordingly the invention has been described by way of illustration rather than limitation.

What is claimed is:

1. A method for connecting vertically extending members and horizontally extending members at a corner joint comprising:

providing a vertically extending scaffold member disposed at a corder of a structure;

providing at said corner a ratchet member which connects to the scaffold member to draw in a direction perpendicular to said scaffolding members;

providing a vertically extending panel having a given width and a given length and providing said length of said vertically extending panel with a border extending along its length;

providing a horizontally extending panel having a given area defined by a given length and a given width with a border extending substantially along its length and ending before the end of said panel;

providing in said border along said length of said horizontal panel a strap member and causing said strap member to be fed into said ratchet for drawing said horizontal member close inwardly toward said scaffolding member; and providing a border at the end of the horizontal panel along said width dimension adjacent said ratchet; and attaching the border of said horizontal panel extending along its width with the vertically extending panel along its length.

* * * * *